US005865601A

United States Patent [19]

Miller

[11] Patent Number: 5,865,601

[45] Date of Patent: Feb. 2, 1999

[54] SAFETY DEVICE FOR AVOIDING ENTRAPMENT AT A WATER RESERVOIR DRAIN HAVING A SECONDARY BLOWING PUMP

[76] Inventor: Bernard J. Miller, 882 Andorra Rd., Lafayette Hills, Pa. 19444

[21] Appl. No.: 19,873

[22] Filed: Feb. 6, 1998

[51] Int. Cl.[6] ..... F04B 41/06

[52] U.S. Cl. ..... 417/2; 417/286; 417/253; 4/541.2; 4/509

[58] Field of Search ..... 417/2, 286, 253; 4/541.2, 509

[56] References Cited

U.S. PATENT DOCUMENTS

| | | | |
|---|---|---|---|
| 4,115,878 | 9/1978 | Johnson et al. . | |
| 4,116,577 | 9/1978 | Lauck | 417/286 |
| 4,456,432 | 6/1984 | Mannino | 417/2 |
| 4,602,391 | 7/1986 | Sheperd | 4/542 |
| 4,620,835 | 11/1986 | Bell . | |
| 4,861,231 | 8/1989 | Howard | 417/38 |
| 5,167,041 | 12/1992 | Burkitt III . | |
| 5,347,664 | 9/1994 | Hamza et al. . | |
| 5,499,406 | 3/1996 | Chalberg et al.. | 4/541.2 |
| 5,570,481 | 11/1996 | Mathis et al. | 4/541.2 |
| 5,682,624 | 11/1997 | Ciochetti | 4/509 |
| 5,690,476 | 11/1997 | Miller . | |
| 5,725,359 | 3/1998 | Dongo et al. | 417/44.9 |

OTHER PUBLICATIONS

Miller, Bernard, M.D. The Development of Heart Lung Machines Mar. 1982 vol. 154, pp. 403–414.

*Primary Examiner*—Charles G. Freay
*Assistant Examiner*—Ehud Gartenberg
*Attorney, Agent, or Firm*—Caesar, Rivise, Bernstein, Cohen & Pokotilow, Ltd.

[57] ABSTRACT

A safety device for avoiding entrapment at a water reservoir drain by using a vacuum operated switch to interrupt power to the reservoir pump and by using a pressure pump to generate a positive pressure to dislodge the obstruction from the drain should a blockage occur. In addition, a manual reset switch requires human intervention to re-activate the reservoir pump once the blockage condition is removed.

12 Claims, 2 Drawing Sheets

SAFETY DEVICE FOR AVOIDING ENTRAPMENT AT A WATER RESERVOIR DRAIN HAVING A SECONDARY BLOWING PUMP

BACKGROUND OF THE INVENTION

This invention relates generally to a safety device used in pools, spas, jacuzzis and other such water reservoirs, and more particularly to water circulating pumps which avoid entrapment of a person or an object that may inadvertently block the pump intake or drain.

In water reservoirs such as pools, whirlpools and spas, a water pump is provided to extract the water from the pool or spa (e.g., through a pump inlet located at the drain of the pool or spa) and to re-circulate the water back into the pool or spa through the nozzles/jets located on the side of the pool or spa, thereby creating turbulence.

Personal contact with the drain can be dangerous, painful or even fatal. A typical drain is 5 to 8 inches in diameter. When the body or hair of a person is positioned in close proximity to the drain, the body or hair may completely block the drain opening thereby creating a vacuum. If the drain is blocked, the person may be entrapped and drowned.

Commonly used recirculating water pumps if obstructed (e.g., completely blocked by the body or hair of a person) can draw a partial vacuum at the drain opening that may exert sufficient suction forces to prevent a person from pulling free of the drain. Even if the person is able to pull free of the sucking drain, bruises or welts may result. In at least one case, a young girl drowned in a hot tub when her hair was caught and sucked into the drain.

One solution to this problem is disclosed in U.S. Pat. No. 5,690,476 (Miller), whose disclosure is incorporated by reference herein. The '476 patent discloses an apparatus for automatically shutting off the pump in a water reservoir should anyone or anything obstruct the water reservoir drain. The present invention is an improvement over this apparatus by including an automatic activation of a positive pressure to assist dislodging the person or thing obstructing the water reservoir drain, as will be discussed below.

Other types of safety devices for avoiding entrapment at the pump intake are commercially available and the patent literature includes various disclosures of such safety devices.

For example, U.S. Pat. No. 4,115,878 (Johnson, et al.) discloses a spa safety drain, which does not employ any springs, valves, electrical components or moving parts of any type, for preventing entrapment at the drain.

U.S. Pat. Nos. 5,167,041 (Burkitt, III) and 5,347,664 (Hamza, et al.) disclose suction fittings for use in a water circulation system that detect blockage to disable the pump in order to prevent damage or physical injury.

U.S. Pat. No. 4,620,835 (Bell) discloses a system to protect the water pump against running dry and against blockage at the drain. This system employs a pressure sensor and pressure switches for interrupting power to the water pump.

Another system that guards against complete occlusion of the intake to a pump has been employed in heart-lung machines, as disclosed in the article by Applicant *The Development of Heart-Lung Machines*, Surgery, Gynecology and Obstetrics, March 1982 at 403.

While some prior art safety devices for avoiding entrapment at the pump intake may be generally suitable for their intended purposes, they nevertheless leave something to be desired for one or more of the following standpoints: safety, reliability, simplicity of construction and cost.

OBJECTS OF THE INVENTION

Accordingly, it is the general object of the instant invention to provide a safety device for avoiding entrapment at the pump intake which meets the above-mentioned needs.

It is a further object of this invention to provide a safety device for avoiding entrapment by detecting blockage at the drain.

It is yet another object of this invention to provide a pressure pump to assist in dislodging the blockage at the drain.

It is yet a further object of this invention to provide a safety device for avoiding entrapment which detects blockage at the drain and automatically de-activates the pump motor.

It is yet a further object of the present invention to provide a safety device for detecting and dislodging a blockage and automatically sounding an alarm of the blockage.

It is another object of this invention to provide a safety device for avoiding entrapment, which has a manual reset button requiring human intervention to re-activate the pool pump once the blockage condition is removed.

SUMMARY OF THE INVENTION

These and other objects of the instant invention are achieved by providing an apparatus for automatically dislodging a person or thing trapped at the drain of a liquid (e.g., water) reservoir. The liquid reservoir includes a liquid reservoir pump that is in fluid communication with the drain at a reservoir pump inlet. The apparatus comprises a pressure pump and a valve coupled together in fluid communication with each other and wherein the pressure pump has an inlet coupled in fluid communication with a liquid source (e.g., a return line to the liquid reservoir) and the valve has an outlet coupled in fluid communication with the drain. The apparatus further comprises an electrical circuit that automatically shuts-off power to the liquid reservoir pump whenever the drain becomes obstructed, while energizing the pressure pump and opening the valve to permit the generation of positive pressure into the drain to dislodge the obstruction.

These and other objects of the instant invention are also achieved by providing an apparatus for automatically dislodging a person or thing trapped at the drain of a liquid reservoir. The liquid reservoir includes a liquid reservoir pump that is in fluid communication with the drain at a reservoir pump inlet. The apparatus comprises a pressure pump and a valve coupled together in fluid communication with each other and wherein the pressure pump has an inlet coupled in fluid communication with an air source and the valve has an outlet coupled in fluid communication with the drain. The apparatus further comprises an electrical circuit that automatically shuts-off power to the liquid reservoir pump whenever the drain becomes obstructed, while energizing the pressure pump and opening the valve to permit the generation of positive pressure into the drain to dislodge the obstruction.

DESCRIPTION OF THE DRAWINGS

Other objects and many of the attendant advantages of this invention will be readily appreciated when the same becomes better understood by reference to the following detailed description, when considered in connection with the accompanying drawings wherein.

DETAILED DESCRIPTION OF THE PREFERRED EMBODIMENTS

Figure 1:
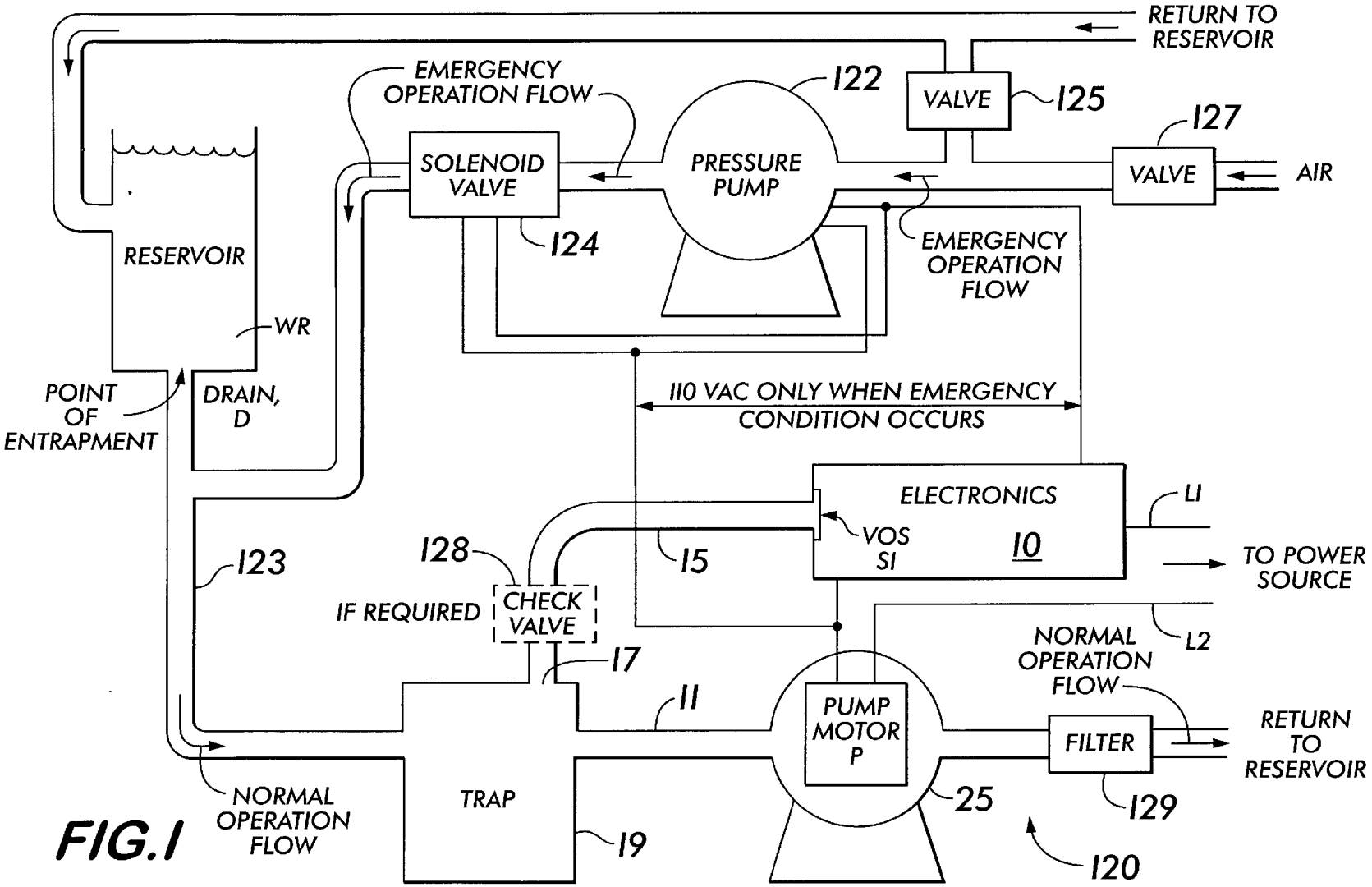
FIG. 1 is a functional diagram of the safety device for avoiding entrapment at the reservoir drain constructed in accordance with this invention and operating under emergency conditions.

Referring now in greater detail to the various figures, wherein like reference characters refer to like parts, there is shown at 120 in FIG. 1, an apparatus for automatically dislodging a person or thing trapped at the drain of a water reservoir WR. The apparatus 120 comprises a pressure pump 122, a valve 124 and an electronic circuit 10. The electronic circuit 10 is similar to the electronic circuit 10 of U.S. Pat. No. 5,690,476 (Miller), whose disclosure is incorporated by reference herein, and operates in accordance with the '476 patent except as discussed below. The pressure pump 122 is coupled in fluid communication to a water reservoir return line 126 at its inlet. The outlet of the pressure pump 122 is coupled in fluid communication to the inlet of the valve 124 (e.g., a solenoid valve, such as those used in washing machines). The outlet of the valve 124 is coupled in fluid communication with the drain D of the water reservoir WR.

It should be understood that, alternatively, the inlet to the pressure pump 122 could be coupled to an air source (not shown), rather than the reservoir return line. An exemplary implementation of such alternative sources is shown in FIG. 1. In particular, a pair of valves 125 and 127 are used to feed either water or air to the pressure pump for generating the positive pressure during an emergency condition. If water is the desired medium, the valve 125 would be opened and the valve 127 would be closed. If air is the desired medium, the valve 127 would be opened and the valve 125 would be closed.

The apparatus 120 of the present invention operates to automatically shut-off a water reservoir pump 25 and set off an alarm A should the drain D in the water reservoir WR become obstructed, in accordance with the '476 patent (the details of which are not repeated here). However, in addition, the present invention 120 also automatically generates a positive pressure from the pressure pump 122 to dislodge the trapped person or thing at the drain D.

Figure 2:
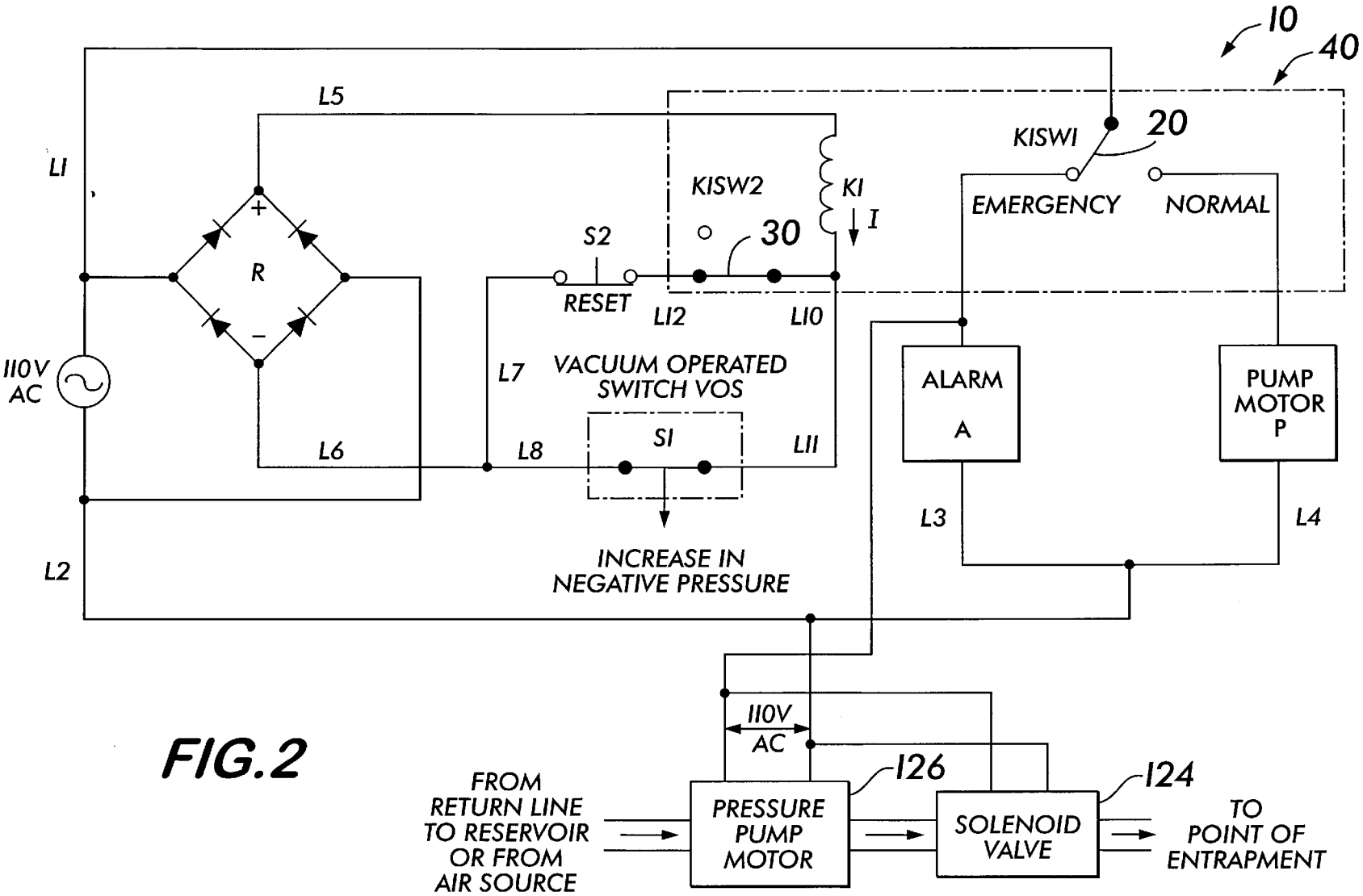
FIG. 2 is an electrical schematic diagram of the invention of FIG. 1 during emergency conditions.

In particular, as shown in FIG. 2, when the drain becomes obstructed, the VOS S1 detects the negative pressure and closes, thereby energizing K1 which causes the armature 20 of K1 SW1 to move to the emergency position. This shuts-off the power to the pump motor P in the water reservoir pump 25 while activating the alarm A. In addition, movement of the armature 20 activates the pressure pump motor 126 in the pressure pump 122 and opens the valve 124. The result is that a positive pressure of water is delivered to the drain that pushes, or dislodges, the obstruction away from the drain D. It should be noted that with the water reservoir pump 25 off, the input line 123 to the trap is, for all intense and purposes, high resistance. Even the filter 129 usually comprises a high density substance (e.g., sand) that acts as high resistance. Thus, all of the positive pressure generated by the pressure pump 122 is directed into the drain D for dislodging the person or thing trapped at the drain D; very little of this positive pressure is directed into the input line 123.

Once the obstruction is cleared away from the drain D, operation of the apparatus 120 is as follows: the water reservoir pump 25 remains off, the alarm A remains on, and the pressure pump 122/valve124 continue to deliver positive pressure until someone activates the reset switch S2. As discussed in the '476 patent, the reset switch S2 assures that there is no automatic reversion to normal operation; instead, someone must actively reset the apparatus 120. Once the reset switch S2 is activated, relay K1 is de-energized which returns the armature 20 to the NORMAL condition. This action: (1) shuts-off the alarm A, (2) shuts-off the pressure pump 122, (3) closes the valve 124 and (4) turns on the water reservoir pump 25.

As can be seen in FIG. 1, a provision for a check valve 128 is available but not necessary. The check valve 128 may be used to protect the VOS S1 from any damage that may occur due to the positive pressure generated by the pressure pump 122 during emergency conditions. It should be understood that any similar-operating device may be used to protect the VOS S1.

As with the devices of the '476 patent, the instant invention is particularly suitable for a pool or spa, but it could be also used in a whirlpool, hot tub and the like.

As shown in FIG. 4 of the '476 patent, it is within the broadest scope of the invention to have the switch K1 SW1, in the alternative, disposed on the L2-side of the power source.

As shown in FIG. 5 of the '476 patent, it is within the broadest scope of this invention that L2 is not limited to a direct connection to L3/L4. Any type of common ground configuration that electrically links L2 and L3/L4 is encompassed by the present invention. For example, the earth could form a portion of L2 for electrically linking it to L3/L4.

As shown in FIG. 6 of the '476 patent, it is within the broadest scope of this invention to include the use of this electrical circuit 10 for controlling a DC pump motor (both the water reservoir pump 25 and the pressure pump 122). In this configuration, the drive coil K1 is directly coupled to the DC power source, $V_{DC}$, without the need for the rectifier R. In addition, the alarm A (either an audible alarm, a visual annunciator, or both) would be operable off of a DC power source.

Without further elaboration, the foregoing will so fully illustrate my invention and others may, by applying current or future knowledge, readily adapt the same for use under various conditions of service.

I claim:

1. An apparatus for automatically dislodging a person or thing trapped at the drain of a liquid reservoir having a liquid reservoir pump in fluid communication with the drain at a reservoir pump inlet, said apparatus comprising:

(a) a pressure pump and a valve coupled together in fluid communication with each other, said pressure pump having an inlet coupled in fluid communication with a liquid source and said valve having an outlet coupled in fluid communication with the drain; and (b) an electrical circuit that automatically shuts-off power to the liquid reservoir pump whenever the drain becomes obstructed, while energizing said pressure pump and opening said valve to permit the generation of positive pressure into the drain to dislodge the obstruction.

2. The apparatus of claim 1 wherein said electrical circuit further comprises an alarm that is automatically activated whenever the drain becomes obstructed.

3. The apparatus of claim 1 wherein said electrical circuit further comprises a reset switch, said reset switch permitting said pressure pump, said valve and said alarm to be shut-off only when the obstruction is dislodged from the drain.

4. The apparatus of claim 3 wherein said reset switch permits the re-energization of the reservoir pump only after the obstruction has been dislodged from the pump.

5. The apparatus of claim 1 wherein the liquid source is a return to the reservoir and wherein the return to the reservoir is in fluid communication with a reservoir pump outlet.

6. The apparatus of claim 5 wherein said electrical circuit further comprises an alarm that is automatically activated whenever the drain becomes obstructed.

7. The apparatus of claim 5 wherein said electrical circuit further comprises a reset switch, said reset switch permitting said pressure pump, said valve and said alarm to be shut-off only when the obstruction is dislodged from the drain.

8. The apparatus of claim 7 wherein said reset switch permits the re-energization of the reservoir pump only after the obstruction has been dislodged from the pump.

9. An apparatus for automatically dislodging a person or thing trapped at the drain of a liquid reservoir having a liquid reservoir pump in fluid communication with the drain at a reservoir pump inlet, said apparatus comprising:

(a) a pressure pump and a valve coupled together in fluid communication with each other, said pressure pump having an inlet coupled in fluid communication with an air source and said valve having an outlet coupled in fluid communication with the drain; and (b) an electrical circuit that automatically shuts-off power to the liquid reservoir pump whenever the drain becomes obstructed, while energizing said pressure pump and opening said valve to permit the generation of positive pressure into the drain to dislodge the obstruction.

10. The apparatus of claim 9 wherein said electrical circuit further comprises an alarm that is automatically activated whenever the drain becomes obstructed.

11. The apparatus of claim 9 wherein said electrical circuit further comprises a reset switch, said reset switch permitting said pressure pump, said valve and said alarm to be shut-off only when the obstruction is dislodged from the drain.

12. The apparatus of claim 11 wherein said reset switch permits the re-energization of the liquid reservoir pump only after the obstruction has been dislodged from the pump.

* * * * *